US005277657A

United States Patent [19]

Truitt

[11] Patent Number: 5,277,657

[45] Date of Patent: Jan. 11, 1994

[54] AIR DISTRIBUTION SYSTEM

[76] Inventor: Archie A. Truitt, 114 Whitewood Terrace, Saskatoon, Saskatchewan, Canada, S7J 4K4

[21] Appl. No.: 921,145

[22] Filed: Jul. 29, 1992

[51] Int. Cl.[5] ..... E06B 7/08

[52] U.S. Cl. ..... 454/198

[58] Field of Search ..... 454/85, 93, 124, 127, 454/188, 191, 193, 198, 211, 214, 219, 222

[56] References Cited

U.S. PATENT DOCUMENTS

| | | | |
|---|---|---|---|
| 587,373 | 8/1897 | Parker et al. | 454/198 |
| 791,924 | 6/1905 | Magee | 454/198 |
| 1,717,904 | 6/1929 | Abernethy | 454/93 |
| 2,799,902 | 7/1957 | Muller | 454/127 |
| 3,729,735 | 4/1973 | Dageford | 236/112 X |
| 3,744,724 | 7/1973 | Caille | 454/198 X |
| 4,537,116 | 8/1985 | Nassof | 454/188 |

FOREIGN PATENT DOCUMENTS

| | | | |
|---|---|---|---|
| 883523 | 7/1953 | Fed. Rep. of Germany | 454/198 |

*Primary Examiner*—Harold Joyce

*Attorney, Agent, or Firm*—Bereskin & Parr

[57] ABSTRACT

An air distribution system for directing air over an inner surface of a window includes an air distribution outlet including an elongate air duct and a distribution divider for dividing the duct longitudinally to define inlet and outlet portions. The inlet portion has an inlet port at one end of the duct for communicating with an air supply source. The divider defines a longitudinal communicating passage for air communication between the inlet and outlet portions, the passage increasing in cross-section with increasing distance from the one end of the duct and the inlet port. The outlet portion has an outlet port extending longitudinally along one side of the duct. The duct is located in the sill or sash of a window such that air may be directed from an air supply source to the inlet port, through the duct, and over the surface of the window.

16 Claims, 7 Drawing Sheets

AIR DISTRIBUTION SYSTEM

FIELD OF THE INVENTION

This invention relates to an air distribution system and in particular to an air distribution system for providing air flow over an inner surface of a window.

BACKGROUND OF THE INVENTION

The problem of condensation collecting on exterior windows is widely recognized and is present in many buildings, particularly in cold weather. The condensation can be unsightly and reduces the natural light available in a building. Also, the condensation may collect at the base of windows, and the resulting dampness problems may cause damage to the building structure and fittings, and encourage the growth of fungi and the like, which can lead to respiratory problems in many individuals.

An early proposal for a ventilator which provides one means for alleviating this problem is disclosed in U.S. Pat. No. 1,308,236 to Glass. The patent discloses a sill which permits air flow from the building exterior through a passage and over the internal surface of a window. The inner end of the passage is provided with a shutter which may be opened or closed as desired, and when open directs the incoming air toward the inner side of the window frame. A conduit is located in the passage and may be used to either heat or cool the air as it passes through the sill.

A further early window ventilator is disclosed in U.S. Pat. No. 1,553,507 to Campbell. Like Glass, Campbell discloses a passage through a sill from the building exterior, which can be opened or closed by means of a suitable shutter. However, in Campbell, a hollow metal frame is provided around the window, the sides of the frame accommodating heating pipes or radiators. Various vents are provided in the frame to allow air to flow from the room, past the heating pipes and back into the room.

In U.S. Pat. No. 2,606,074 to Ackerman, an air distribution nozzle is disclosed which is adapted for use in directing a stream of air over a show window, to keep the window free of condensation. The nozzle is intended for location at the centre of a lower edge of the window and directs air from a single source in a 180° arc through use of radially extending ducts defined by a plurality of internal triangular divisions.

Whereas the earlier patents to Glass and Campbell disclose heating means located in the window frame itself, a number of later patents disclose systems in which heated air is supplied from a remote source, relayed through communicating ducts, and passed through a sill or duct assembly extending along the base of a window. U.S. Pat. No. 2,446,356 to Van Alsburg discloses a system of this type in which an air outlet with an elongate inlet leads into a hollow, sheet metal housing provided with air outlet openings on an upper surface, and an elongate slot in a lower surface. The air passing upwardly through the outlet openings in the upper surface is intended to mingle with the air closest to the window glass, and the air passing through the slot is intended for intermingling with air farther away from the window.

In German Patentschrift No. 883,529, to Jutzi, a hollow sill having apertures in an upper surface is disclosed, warm air being supplied from a blower and burner to the sill, to pass up and over an inner surface of a window.

In U.S. Pat. No. 3,439,601 to Cooper a forced air circulating system is disclosed, in which air is supplied from a fan or pump unit through horizontal ducts. The air passes from the ducts into a larger volume air cavity which reduces the pressure of the air. The air flows upwardly through the cavity to a hollow sill member and exits through slots in the sill member. The dimensions of the slots are considerably smaller than the interior of the sill member to produce an increase in velocity of the air as it passes through the slots such that the air is forced upwards to travel along the inside surface of a window.

SUMMARY OF THE INVENTION

In accordance with the present invention there is provided an air distribution outlet for an air distribution system comprising an elongate air duct and a distribution divider for dividing the duct longitudinally to define inlet and outlet portions. The inlet portion has an inlet port at one end of the duct for communicating with an air supply source and the outlet portion has an outlet port extending longitudinally along one side of the duct. The divider defines a longitudinal, communicating passage for air communication between the inlet and outlet portions, the passage increasing in cross-section with increasing distance from the one end of the duct and the inlet port.

The outlet is preferably located in the sill or sash of a window, adjacent a lower edge of the glass pane.

Warmed air may be supplied from a remote air source, such as furnace, through suitable ducting to the inlet port. The air passes into the inlet portion through the inlet port and then passes through the communicating passage in the divider into the outlet portion. The heated air then passes through the outlet port and rises up the inner surface of the window. The configuration of the divider assists in providing an even supply of air along the length of the duct, even though the inlet port is located at one end of the duct.

In accordance with a further aspect of the present invention there is provided an air distribution assembly for use in combination with an opening window comprising an air distribution duct for location in a lower sash of a window frame and an air supply duct for extending from an air supply source to the air distribution duct. The air supply duct includes a valve adapted to close on opening of the window and the air distribution duct including a valve opening member adapted to open the valve on closing of the window.

Preferably, the valve is in the form of a closure member biased to close the air supply duct and the valve opening member contacts the closure member when the window is closed and pushed the closure member to an open position.

This arrangement is useful, for example, where an air supply source supplies air to a number of air distribution assemblies and prevents loss of heated air where one or more of the windows is opened.

BRIEF DESCRIPTION OF THE DRAWINGS

This and other aspects of the present invention will now be described, by way of example, with reference to the accompanying drawings, in which.

DETAILED DESCRIPTION OF PREFERRED EMBODIMENTS

Figure 1:
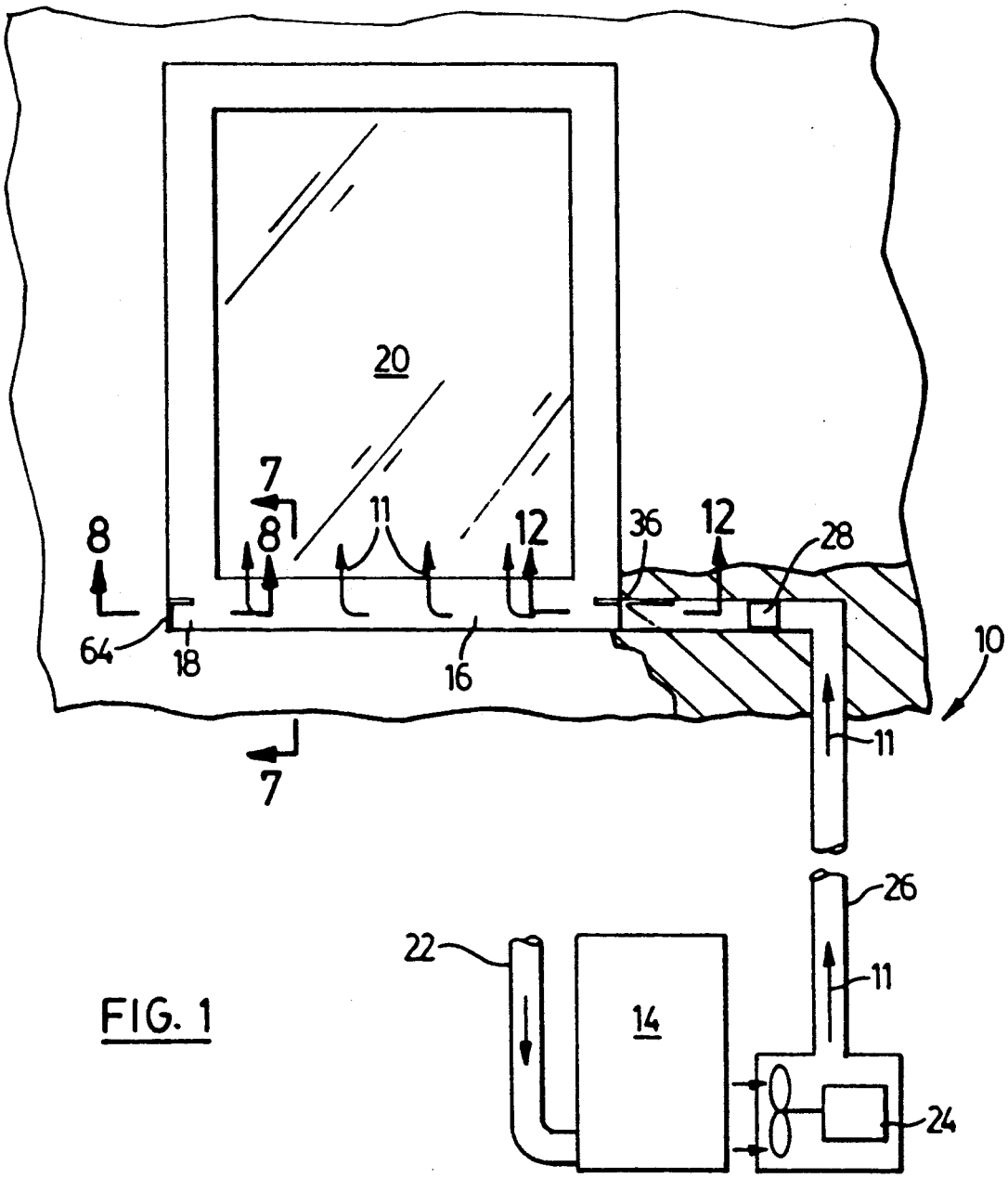
FIG. 1 is a simplified view of an air distribution system in accordance with the present invention.

Reference is made first to FIG. 1 of the drawings which illustrates an air distribution system, generally indicated by the numeral 10, in which heated air, indicated by arrows 11 is supplied from a forced air furnace 14 to an air duct 16 located in the sash or sill 18 of a window 20 to keep the inside surface of the window free from condensation.

Figure 2:
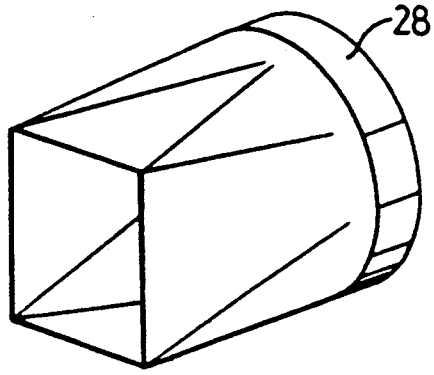
FIG. 2 is a perspective view of a round to rectangular connector for use in the distribution system of FIG. 1.

The furnace 14 is merely exemplary of a warm air supply, and includes a conventional cold air return 22 and a multiblade, variable speed fan 24, which draws the heated air from the furnace 14 and pushes it through a suitable duct system. For simplicity, only a single duct 26 is illustrated and in the preferred embodiment, the duct 26 is formed of conventional, cylindrical, galvanized steel lengths. The ducting extends to adjacent the lower side of the window 20, where a round to rectangular coupling 28 is provided and which leads into the rectangular air duct 16, which is located in the lower sash or sill 18 of the window. The round-to-rectangular coupling 28 is illustrated in more detail in FIG. 2 of the drawings. As will be described below, the duct 16 is arranged such that the heated air is evenly distributed over the width of the window and rises over the inner surface of the window to maintain the surface condensation free.

Figure 3:
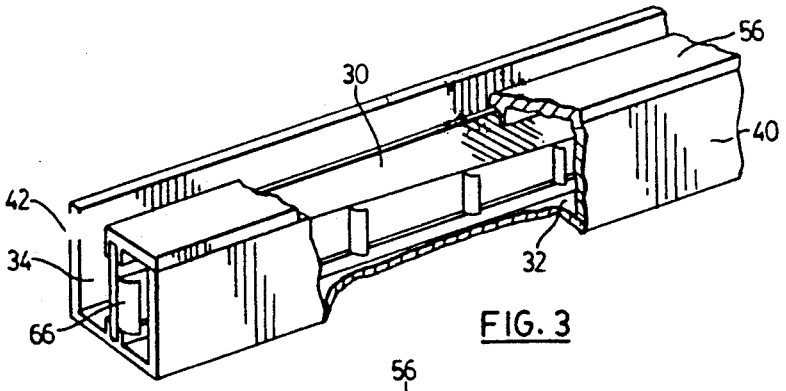
FIG. 3 is a partly cut away perspective view of an air duct forming part of the air distribution system of FIG. 1.
Figure 4:
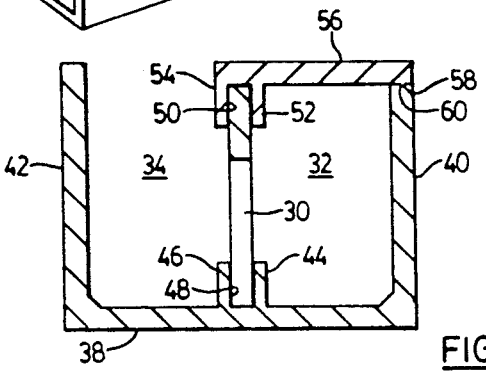
FIG. 4 is an enlarged sectional view of the air duct of FIG. 3.
Figure 5:
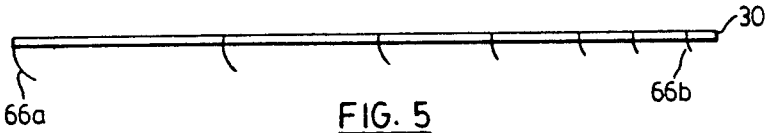
FIG. 5 is a plan view of a distribution divider forming part of the air duct of FIG. 3.
Figure 6:
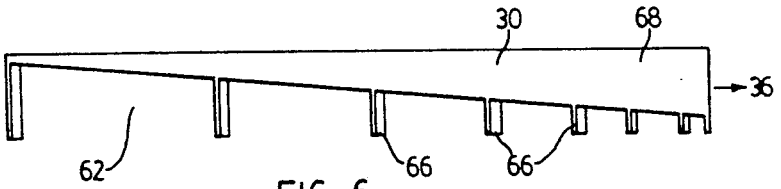
FIG. 6 is an elevation of the distribution divider of FIG. 3.

Reference is now also made to FIGS. 3, 4, 5 and 6 of the drawing, FIG. 3 showing a partly cut away portion of air duct, FIG. 4 illustrating the air duct 16 in section, and FIGS. 5 and 6 illustrating a distribution divider 30 which is located within the duct 16 and divides the duct 16 longitudinally to define inlet and outlet portions 32, 34. The inlet portion 32 is formed on the right hand side of the duct, as shown in FIG. 4, and is in direct communication, via an inlet port 36 (FIG. 1), with the rectangular portion of the air duct 26. It will be noted from FIG. 1 that the inlet port 36 is located at one side of the window 20.

The duct 16 has a base 38 and upstanding sides 40, 42 and extending longitudinally along the centre of the base 38 are two ribs 44, 46 which define a longitudinal slot 48. Opposing the slot 48 is a second slot 50 formed by two ribs 52, 54 which extend along the edge of a vent cap 56 which extends from the duct side 42, and encloses the top of the inlet portion 32. The edge of the vent cap 56 is provided with a longitudinal bead 58 for location in a complementary recess 60 in the upper end of the side 42. The slots 48, 50 serve to locate a distribution divider 30 which, if reference is made to FIGS. 3 and 6, may be seen to define a tapered opening 62, the divider 30 being located in the duct 16 with the opening 62 increasing in cross section from a minimum adjacent the inlet port 36, to a maximum at the opposite end of the duct, which is closed by an end cap 64 (FIG. 1). The opening 62 is provided at the base of the divider 30 and is punctuated by upright fins 66 extending downwardly from a triangular portion 68, the spacing between the fins increasing with the increasing cross section of the opening 62. In the particular example illustrated, where the divider 30 is two feet long, the fins are spaced by 1", 2", 3", 4", 5"and 7". Also, the fins 66 extend into the inlet portion 32 and, as may be seen in FIG. 3 and 5, the fins 66 extend further into the inlet portion 32 with increasing distance from the inlet port 36. In this particular example the distribution divider 30 is formed of 1/16" sheet and the longest fin 66*a* exceeds ½ into the inlet portion 32 while the first fin 66*b*, extends ¼ into the inlet portion 32.

By providing the arrangement of fins and a tapered opening as described above, the air entering the one end of the duct at the inlet port 36 is distributed evenly from the inlet portion 32 into the open topped outlet portion 34, from where the warm air passes up over the inside surface of the window 20.

As windows come in a great variety of forms, the mounting of the air duct 26 and the link between the air supply duct 26 and the air duct 16 will vary according to the particular application. By way of example, there follows descriptions of windows of various forms provided with an air distribution system, as broadly described above.

Figure 7:
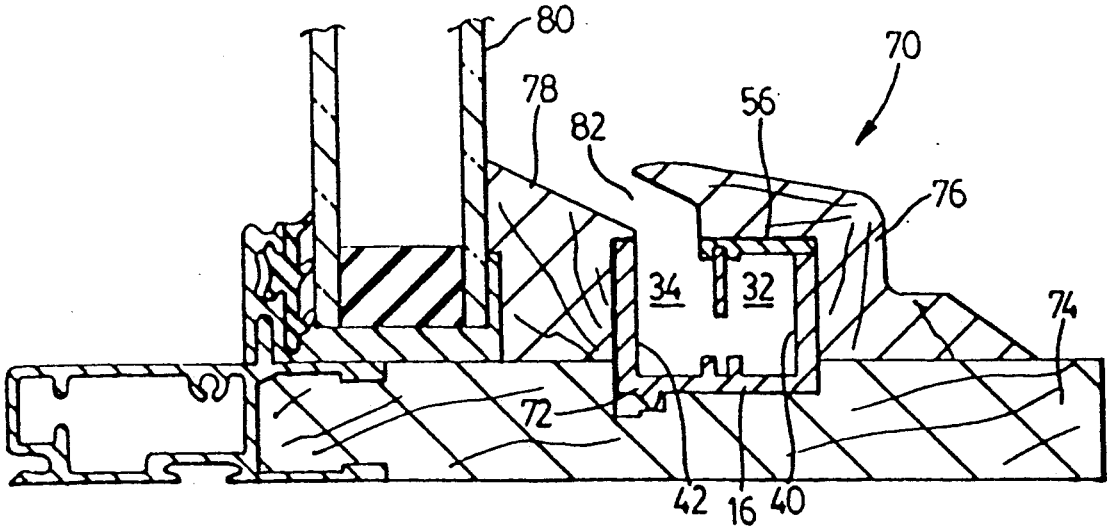
FIG. 7 is a sectional view corresponding in location to line 7—7 of FIG. 1, where the window of FIG. 1 is fixed.

Reference is first made to FIG. 7 of the drawings which illustrates an air duct 16 located in a fixed unit, generally indicated at 70. The duct 16 sits in a groove 72 provided in the window sill 74 and is located between two wooden straps 76, 78. The strap 78 adjacent the window pane extends over the top of the side 42 of the duct and slopes upwardly to the inside face of the inner pane 80. The other strap 76 rests on the sill 74 and extends over the side 40 and vent cap 56, and then extends upwardly and towards the pane 80 to define an air passage 82 for the air leaving the outlet portion 34.

Figure 8:
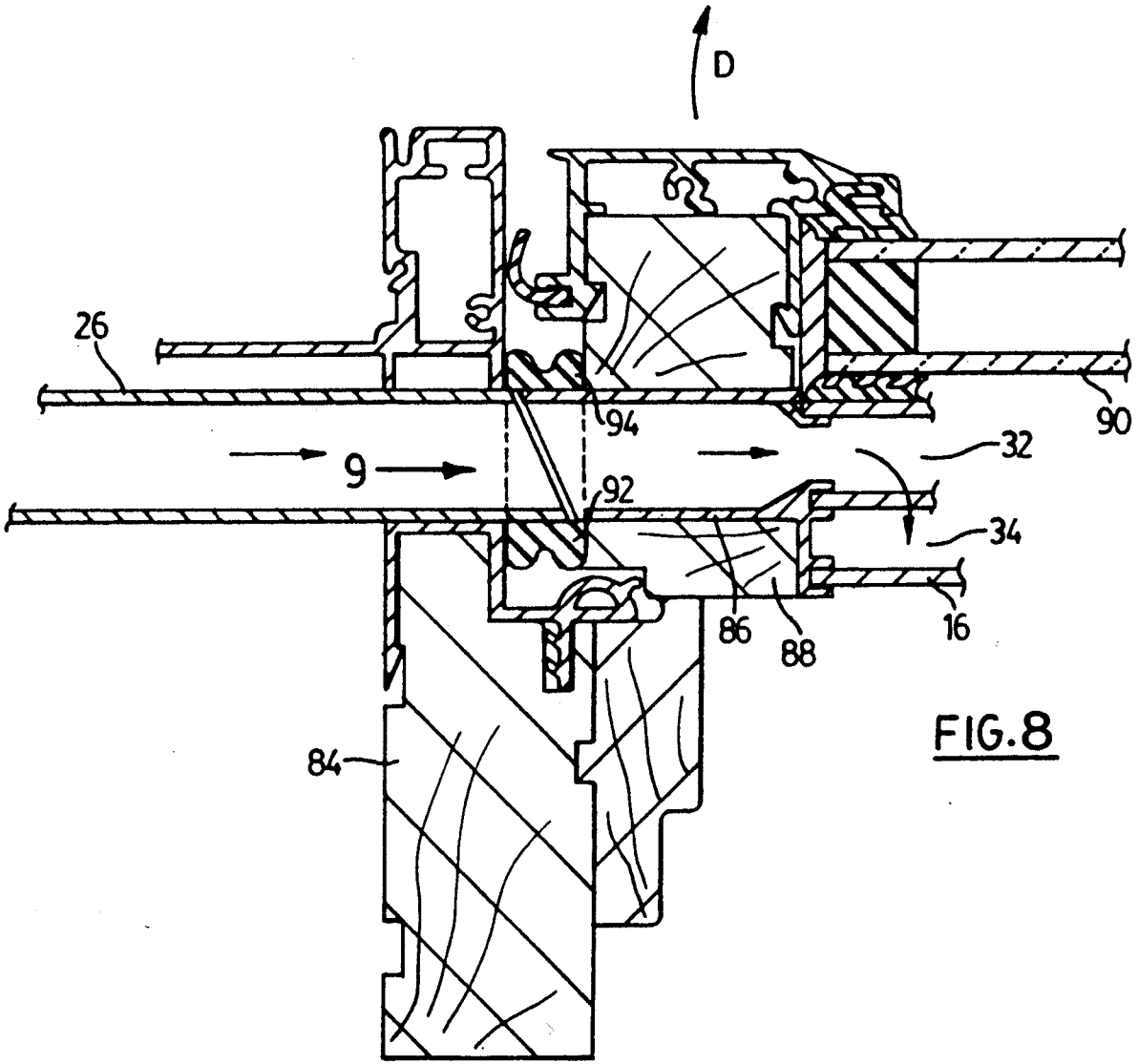
FIG. 8 is a sectional view corresponding to line 8—8 of FIG. 1, where the window of FIG. 1 is openable by pivoting about line a-a, and where the inlet to the air ducts is located to the left hand side of the window (as shown in ghost outline)

Reference is now made to FIG. 8 of the drawings, which illustrates a section of a window and frame, where the window is pivotal about an upright axis and is open by moving the side of the window in direction D. The air duct 26 can be seen extending from the left of the figure through the jamb 84, into a short duct 86 extending through the window side sash 88 and into the inlet portion 32 of the duct 16. The arrangement differs somewhat from that described in FIG. 7 above, in that the outlet portion 34 of the duct 26 is located further from the window pane 90 than the inlet portion 32. The intersection between the duct 26 and the duct 86 is located in a space between the jamb 84 and the sash 88, the ends of the ducts 26, 86 being cut at an oblique angle to permit opening of the window. A resilient seal 92 is mounted on the inside of the gap on the end of the duct 16, while a further seal 94 is mounted on the outer side of the gap on the end of the duct 86.

Figure 9:
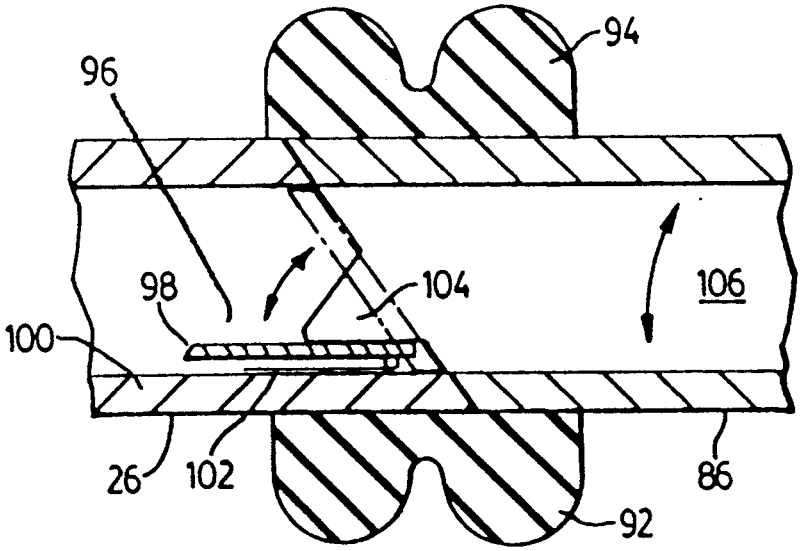
FIG. 9 illustrates a valve arrangement provided in area 9 of FIG. 8.

When the window is opened, it is desirable that the duct 26 is closed, such that the heated air from the furnace does not continue to flow through the open end of the duct. To close the duct 26, a valve arrangement is provided, and this is shown in more detail in FIG. 9 of the drawings. Mounted on the end of the duct 26 is a pedal valve 96 in the form of a rectangular closure member 98 mounted on a sidewall 100 of the duct via a spring 102 which tends to push the closure member 98 from a position parallel and adjacent to the sidewall 100 to the position shown in ghost outline in FIG. 9, in which the member 98 extends across the duct and closes the end of the duct. FIG. 9 illustrates the closure member 98 in the open configuration, the member 98 being held open by a raised extension 104 which extends from the base 106 of the duct end 86. When the window is closed, the end of the triangular extension 104 bears against the outer face of the closure member 98 and pushes it into the open configuration.

Figure 10:
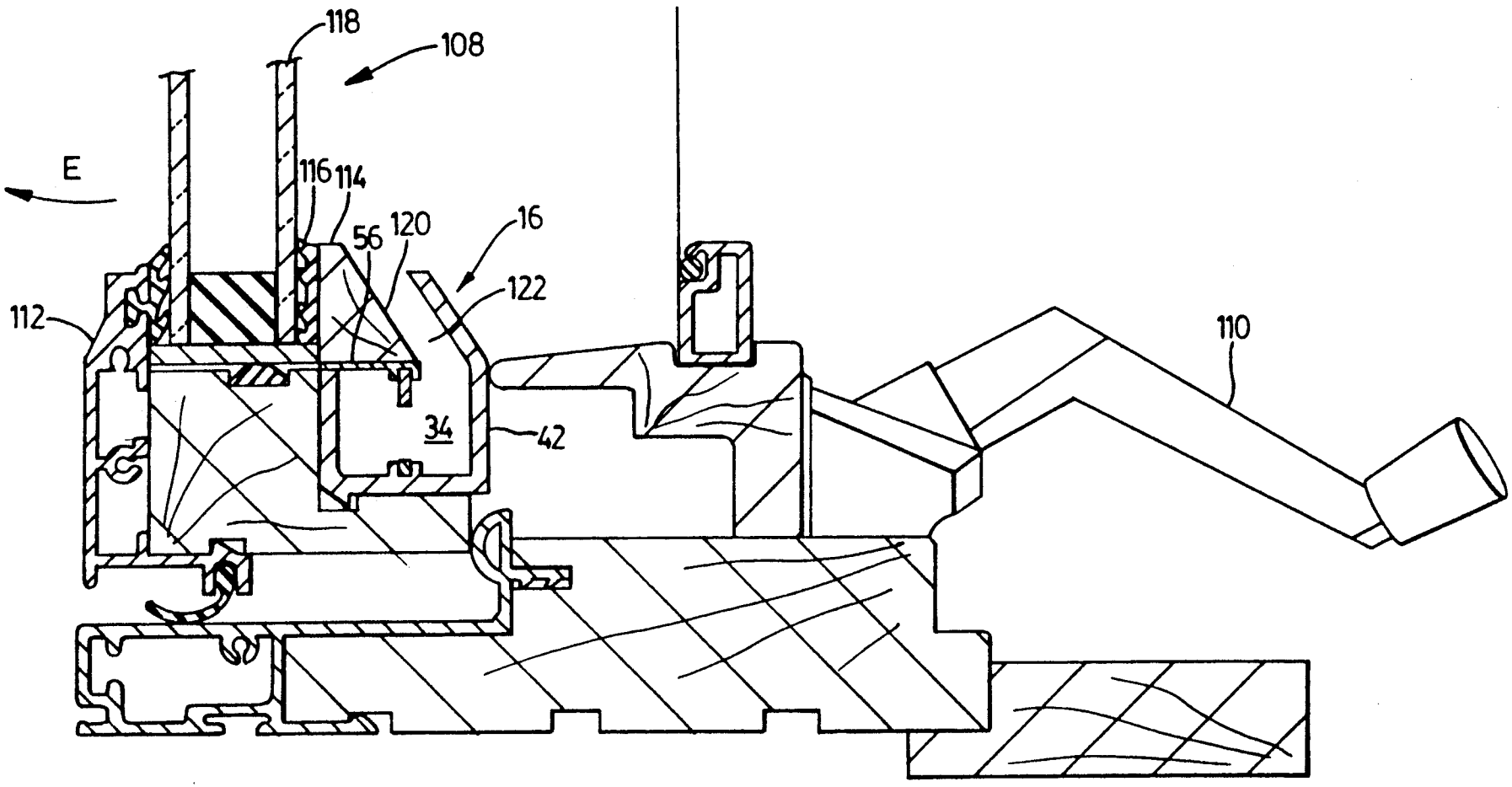
FIG. 10 is a sectional view corresponding to line 7—7 of FIG. 1 where the window is of the casement and awning type.

Reference is now made to FIG. 10 of the drawings, which illustrates a window 108 which is moveable about a horizontal axis. In this particular example the window being opened by rotation of a handle 110 to move in direction E.

The duct 16 is located in the window sash 112, a wedge shaped strap 114 being located over the vent cap 56 and adjacent the sealing edge 116 at the base of the inner pane 118. In this particular embodiment the side 42 of the duct 16 is extended and runs parallel to a face 120 of the strap 114 to define a passage 122 leading from the outlet portion 34 to the base of the inner pane.

Figure 11:
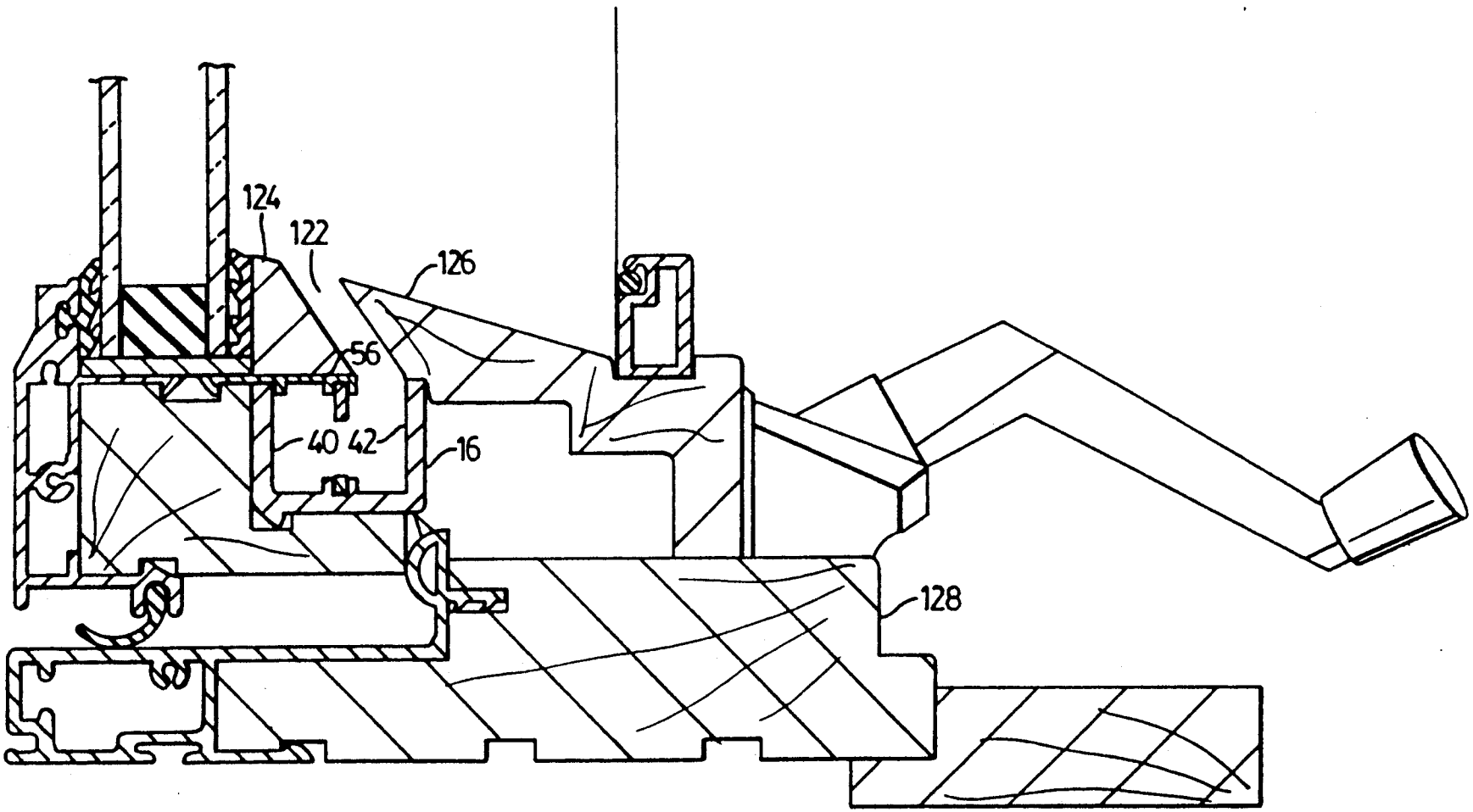
FIG. 11 corresponds to a sectional view of line 7—7 of FIG. 1, where the window is of the casement type.

FIG. 11 illustrates a somewhat similar arrangement, but in which the duct 16 is provided with sides 40, 42 of similar height, the passage 122 from the duct 16 to the base of the window being defined by a strap 124 mounted above the vent cap 56 and a fixed sill portion 126 located on the window sill 128.

Figure 12:
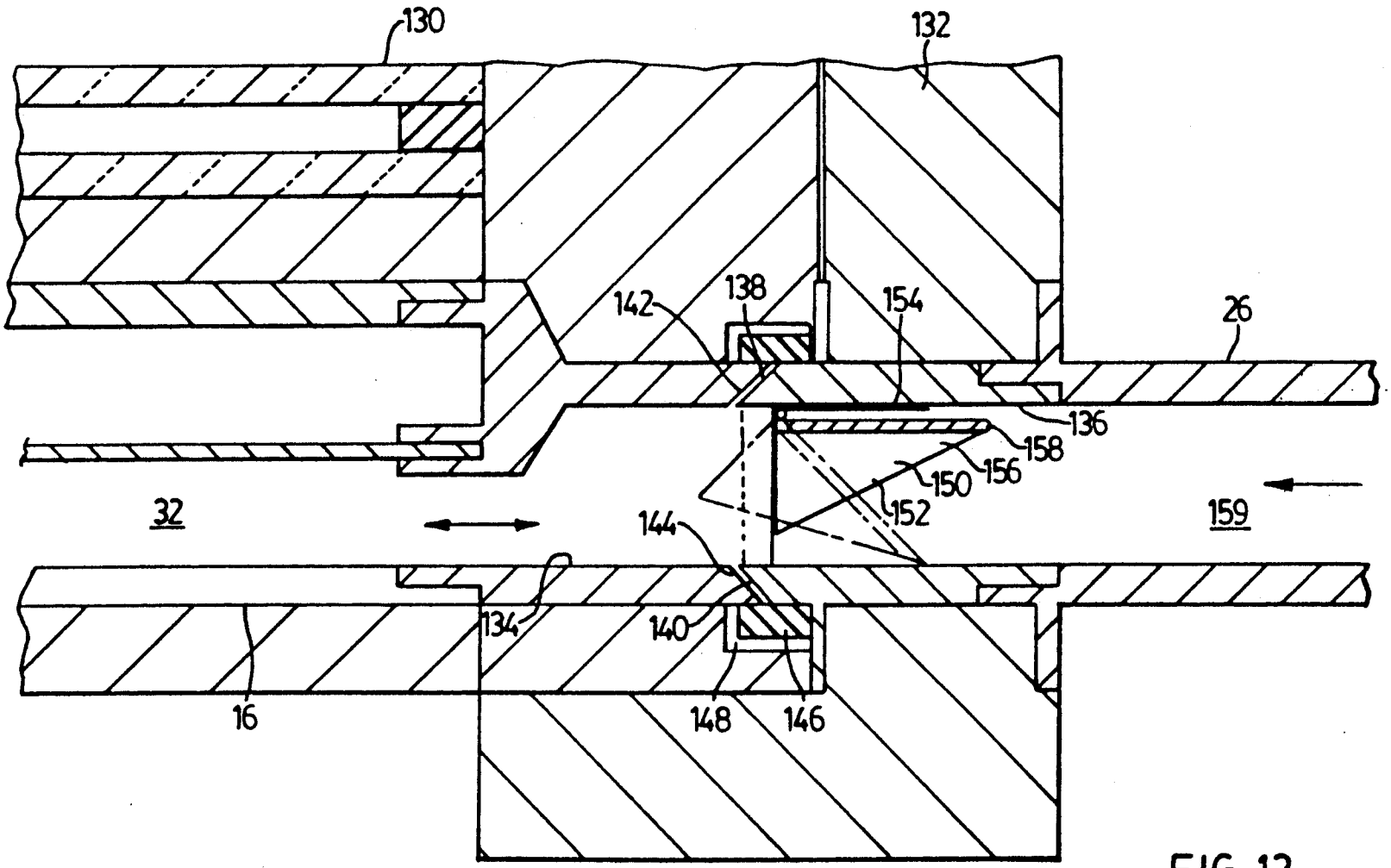
FIG. 12 corresponds to a sectional view on line 12—12 of FIG. 1, where the window is of the sliding type.

Finally, reference is made to FIG. 12 of the drawings, which illustrates an edge portion of a sliding window 130 and a associated jamb 132. The end of the duct 26 may be seen extending from the right hand side of the figure and communicates with a short duct 134 which communicates with the inlet portion 32 of a duct 16. The figure is primarily intended to illustrate the means for closing the ends of the duct 26 when the window 130 is opened. It will be noted that the duct 26 includes a short extension 136 having tapered wall ends 138, 140 arranged to be received within the flared wall ends 142, 144 of the duct 134 leading to the distributing duct 16. A resilient sealing member 146 is mounted in a channel 148 which extends around the end of the duct 134. The sealing member 146 extends beyond the end of the duct 134, such that when the window is closed, the sealing member 146 covers the small space between the ends of the ducts 134, 136.

To permit sealing of the duct 26 when the window is open, a pedal valve 150 is provided in the duct extension 136 and comprises a triangular closure member 152 mounted on the sidewall of the duct through a spring 154. The closure member 152 comprises a triangular base 156 and a rectangular, upright portion 158 which lies parallel and adjacent to the duct wall when the valve 150 is in the open configuration. The base 156 lies parallel to an adjacent lower wall 159 of the duct extension and, in the open configuration, the end of the base 156 abuts an end portion of the base of the short duct 134. Thus, when the window is opened the spring rotates the closure member such that the upright portion 158 extends across and seals the duct extension 136, and the duct 26.

Thus, it will be apparent that the present invention provides a simple yet effective air distribution system.

It will be clear to those skilled in the art that the above description is merely exemplary, and that various modifications and improvements may be made to the present invention without departing from the scope of the invention.

I claim:

1. An air distribution outlet comprising:

an elongate air duct; and a distribution divider for dividing the duct longitudinally to define inlet and outlet portions, the distribution divider having a plurality of fins extending into the inlet portion, the duct defining an inlet port at one end of the inlet portion for communication with an air supply source, and the duct further defining an outlet port for the outlet portion extending longitudinally of the duct, wherein the distribution divider defines a communicating passage for air communication between the inlet and the outlet portions, the passage increasing in cross-section with increasing distance from said inlet port, the fins increasing in length with increasing distance from said inlet port, and the spacing between the fins increasing with increased distance from said inlet port.

2. The air distribution outlet of claim 1, wherein the fins are curved toward said inlet port.

3. The air distribution outlet of claim 2, wherein the distribution divider is generally rectangular and the passage is in the form of an opening extending longitudinally of the divider.

4. The air distribution outlet of claim 3, wherein the air duct comprises a U-shaped trough having a vent cap extending between one side of the trough and the distribution divider to define the inlet portion.

5. The air distribution outlet of claim 4, wherein the base of the trough is provided with a longitudinal slot to receive and locate a lower edge of the distribution divider.

6. The air distribution outlet of claim 5, wherein the vent cap is provided with a longitudinal slot on one side thereof to receive and locate an upper edge of the distribution divider.

7. The air distribution outlet of claim 6, wherein the vent cap is provided with a longitudinal bead on the other side thereof for location in a complementary recess in the upper end of said one side of the trough.

8. The air distribution outlet of claim 1, 2, 3, 4, 5, 6, or 7 in combination with a window sash wherein said outlet is located in a lower portion of the window sash at the base of a window pane thereof.

9. The air distribution outlet of claim 1, 2, 3, 4, 5, 6, or 7, in combination with a window sill, wherein said outlet is located in a lower portion of a window sill at the base of a window pane thereof.

10. The air distribution outlet of claim 1, in combination with a window frame which includes a window sash movably mounted in the window frame, a lower portion of the sash including the air distribution outlet wherein a deflector is provided for directing air from the outlet port onto a lower portion of the window.

11. The air distribution outlet of claim 10, wherein the deflector is in the form of a longitudinal passage, the sides of the passage being formed by a lower portion of the window sash.

12. The air distribution outlet of claim 10, wherein the deflector is in the form of a longitudinal passage, one side of the passage being formed by a lower portion of the window sash and the other side of the passage being formed by a lower portion of the window frame.

13. An air distribution assembly for use in combination with an opening window comprising:

an elongate air distribution duct for location in the lower portion of a window frame; and an air supply duct for extending from an air supply source to the air distribution duct, the elongate air distribution duct including a distribution divider for dividing the duct longitudinally to define inlet and outlet portions, the duct defining an inlet port at one end of the inlet portion for communication with the air supply duct and the duct further defining an outlet port for the outlet portion extending longitudinally of the duct, the distribution divider having a plurality of fins extending into the inlet portion, the fins increasing in length with increasing distance from said inlet port, and the spacing between the fins increasing with increased distance from said inlet port, the distribution divider defining a communicating passage for air communication between the inlet and outlet portions, the passage increasing in cross-section with increasing distance from said one end, and the air distribution duct including valve means adapted to close on opening of the window and the air distribution duct including valve opening means adapted to open the valve means on closing of the window.

14. The air distribution assembly of claim 13, wherein the valve means includes a closure member biased to close said air supply duct.

15. The air distribution assembly of claim 14, wherein the air distribution duct includes a valve opening member adapted to engage the closure member and open said air supply duct on closing the window.

16. The air distribution assembly of claim 15, wherein the closure member is mounted on the air supply duct through a spring and the value opening member extends from the air distribution duct.

* * * * *